United States Patent [19]

Bertrand

[11] 3,964,130

[45] June 22, 1976

[54] METHOD OF AND DEVICE FOR OPENING BIVALVULAR MOLLUSKS

[76] Inventor: Henri Bertrand, 20, rue d'Alsace-Lorraine, 45000 Orleans, France

[22] Filed: July 3, 1974

[21] Appl. No.: 485,581

[30] Foreign Application Priority Data

July 16, 1973 France ..... 73.25946

[52] U.S. Cl. ..... 17/45; 17/48; 17/74

[51] Int. Cl.[2] ..... A22B 3/00

[58] Field of Search ..... 17/74, 75, 71, 72, 73, 17/51, 48, 45; 99/568, 526, 532, 533; 426/479

[56] References Cited

UNITED STATES PATENTS

| | | | |
|---|---|---|---|
| 1,352,108 | 9/1920 | Arthur | 17/75 |
| 2,854,688 | 10/1958 | Colangelo | 17/75 |
| 3,174,180 | 3/1965 | Bertrand | 17/74 |
| 3,696,465 | 10/1972 | Rossnan | 17/48 |
| 3,758,921 | 9/1973 | Ingalls | 17/48 |

*Primary Examiner*—Louis G. Mancene
*Assistant Examiner*—James D. Hamilton
*Attorney, Agent, or Firm*—Wenderoth, Lind & Ponack

[57] ABSTRACT

Bivalvular mollusks, notably oysters, are opened by inserting a sharp tool or nozzle formed with an internal passage into the mollusk, between the two valves or shells thereof, and allowing compressed air to flow through the passage. The tool may comprise a needle shaped nozzle or a blade-shaped nozzle. The compressed air may be supplied either from a foot-operated pump to free the hands of the user or from a releasable cartridge associated with or constituting the handle of the device.

13 Claims, 4 Drawing Figures

METHOD OF AND DEVICE FOR OPENING BIVALVULAR MOLLUSKS

BACKGROUND OF THE INVENTION

This invention relates in general to methods and devices for opening bivalvular mullusks and has specific reference to a method of opening bivalvular mollusks and notably flat oysters (*O strea edulis*) and Portuguese oysters (*Gryphaea* on *Crassostrea angulata*).

To facilitate this opening operation various methods and means have already been proposed, but all of them are characterized however by serious inconveniences, notably that of being relatively complicated and requiring the implementing of a relatively considerable souce of power, or alternatively, in the case of relatively simple devices, these proved to be inefficient and liable to be easily damaged.

SUMMARY OF THE INVENTION

The method of this invention is free of these inconveniences. Although it is simple to perform and does not require complicated means or a considerable power source, it is extremely efficient for the work contemplated.

This method is characterized in that it consists in inserting a nozzle between the valves or shells of the mollusks, and causing compressed air to flow through the nozzle in order to release the mollusk's muscle normally holding the oyster tightly closed.

According to a typical embodiment of this invention, the nozzle for introducing compressed air into the bivalvular mollusk consists of a hollow needle having an orifice for connecting the nozzle to the outside, i.e. with the interior of the mollusk, the needle being on the other hand connected to the source of compressed air after having been inserted into the oyster.

According to another embodiment the nozzle for introducing compressed air consists of a blade having a passage connected to an orifice leading to the outside and communicating with a tubular portion connected in turn to the source of compressed air.

In all cases a nozzle or conduit, in the form of a needle, blade or the like, designed in such a way and made from a material having enough strength to withstand its introduction between the mollusk valves without being damaged, while having a good resistance to corrosion by sea water, is contemplated. Advantageously, stainless steel will be used to this end, notably a 18-8 Ni-Cr alloy containing 3% molybdenum.

The compressed air source may consist of a pump, preferably a foot-operated pump in order to free the user's hands.

The fluid utilized for operating the tool may also consist of compressed air contained in a cartridge. This cartridge may be an integral part of the nozzle means for introducing the air into the mollusk.

BRIEF DESCRIPTION OF THE DRAWINGS

Other features of the invention will become apparent from the following description taken with the accompanying drawings, wherein.

DETAILED DESCRIPTION OF THE INVENTION

Figure 1:
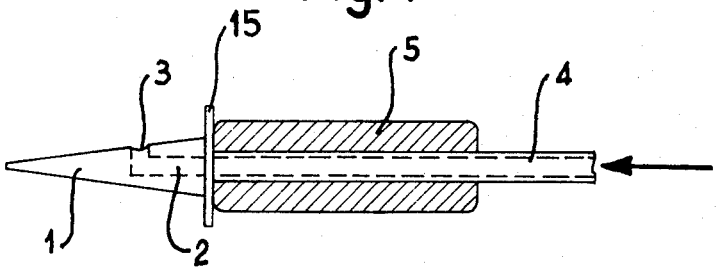
FIG. 1 is a side elevational and part-sectional view of the nozzle means according to this invention for opening bivalvular mollusks.

In FIG. 1 the device is shown as comprising a needle having a solid point 1 in order to have a strength sufficient for withstanding the introduction thereof between the two valves or shells, this point 1 having however an inner passage 2 opening to the outside through an outlet orifice 3 directed at right angles to the passage 2, the latter being connected via a pipe 4 to a source of compressed air, for instance a foot-operated pump (not shown). This device may be completed by a handle 5 to facilitate the insertion of the needle 1.

This needle 1 may be introduced at any suitable location between the valves or shells, for example at the foot or hinge portion of the bivalvular mollusk.

Figure 2:
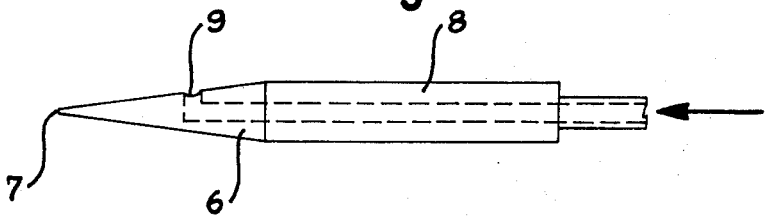
FIGS. 2 and 3 are a side-elevational view and a plane view from above, respectively, of a modified embodiment of the device of this invention.
Figure 3:
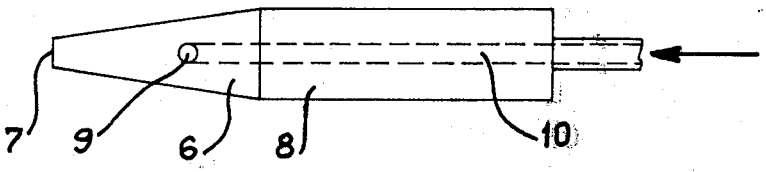

In the modified embodiment illustrated in FIGS. 2 and 3, the device comprises essentially a blade 6 having a relatively sharp edge 7 and a hollow cylindrical body 8 formed with an orifice 9 communicating via a pipe 10 with a souce of compressed air. This blade 6 may also have a handle to facilitate its insertion.

Figure 4:
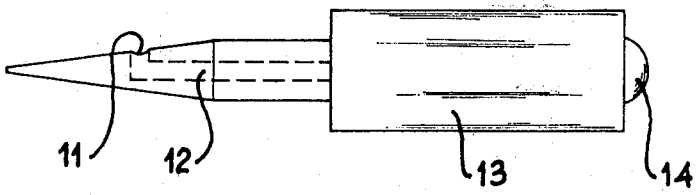
FIG. 4 is a side-elevational view of a further embodiment wherein the nozzle means is incorporated in a cartridge filled with air under pressure.

In the modified embodiment illustrated in FIG. 4 the device is of the needle type as illustrated in FIG. 1, but this needle has an orifice 11 opening to the outside and communicating with the inner passage which is supplied with compressed air from a cartridge 13 forming a unitary assembly with the needle. The valve controlling the release of compressed air contained in cartridge 13 may be actuated for example by means of a push-button or like member 14. This cartridge 13, which may be screwed onto the needle body to permit its replacement when exhausted with a fresh, filled cartridge, may also act as a grip handle for utilizing the device. Advantageously, as illustrated in FIG. 1, a washer 15 of resilient material may be provided for the dual purpose of sealing the joint between the needle 1 and handle 5, and preventing the backflow or splashing of liquid from within the oyster. Furthermore, this washer may also efficiently protect the user's fingers when introducing the needle 1 into the oyster.

In addition to the above-mentioned advantages, the device of this invention is also useful in that when the compressed air has exerted the action necessary for opening the oyster, it further expels or drives out the foreign substances likely to be enclosed in the mollusk. This action is particularly useful in case sand or mud are present in the mollusk, as frequently occurs in cockles, clams (*Venus verrucosa*) or nut clams, where relatively large amounts of sand are usually found.

Of course this invention should not be construed as being strictly limited to the specific embodiments described and illustrated herein, since various modifications and changes may be made thereto without departing from the basic principle of the invention.

Furthermore, it will be readily understood by those conversant with the art that this invention is applicable to the opening of all bivalvular mollusks whether from salt waters or soft waters.

What I claim is:

1. A method of opening bivalvular mollusks, notably flat oysters (*Ostrea edulis*) and Portuguese oysters (*Gryphaea* or *Crassostrea angulata*), said method comprising:

providing an elongated member having a sharpened end and a passage extending longitudinally within said member, said passage opening at a first end thereof into an orifice on a lateral surface of said member;

introducing said member between the mollusk valves or shells; and feeding compressed air through said passage and said orifice against one of said shells and releasing the mollusk muscle normally closing said mollusk, thereby forcing apart said mullusk shells.

2. A device for opening bivalvular mollusks, said device comprising:

an elongated member having a sharpened end, a passage extending longitudinally within said member, said passage opening at a first end thereof into an orifice on a lateral surface of said member, said sharpened end comprising means for insertion between the shells of a bivalvular mollusk; and means for supplying compressed air through said passage and out said orifice against one of said shells for releasing the mollusk muscle normally closing said mollusk and thereby forcing apart said mollusk shells.

3. A device as claimed in claim 2, wherein said elongated member comprises a needle-shaped member, and said sharpened end comprises a point.

4. A device as claimed in claim 3, wherein said orifice is spaced from said point.

5. A device as claimed in claim 4, wherein said supplying means comprises an air pump, notably a foot-operated pump.

6. A device as claimed in claim 4, wherein said supplying means comprises a compressed air cartridge.

7. A device as claimed in claim 6, wherein said cartridge is fitted directly on a handle carrying said needle-shaped member.

8. A device as claimed in claim 4, wherein said needle-shaped member is formed of 18-8 Ni-Cr steel containing 3% molybdenum.

9. A device as claimed in claim 2, wherein said elongated member comprises a blade-shaped member, and said sharpened end comprises a sharp blade edge.

10. A device as claimed in claim 9, wherein said supplying means comprises an air pump, notably a foot-operated pump.

11. A device as claimed in claim 9, wherein said supplying means comprises a compressed air cartridge.

12. A device as claimed in claim 11, wherein said cartridge is fitted directly on a handle carrying said blade-shaped member.

13. A device as claimed in claim 9, wherein said blade-shaped member is formed of 18-8 Ni-Cr steel containing 3% molybdenum.

* * * * *